US005434596A

United States Patent [19]

Stephenson

[11] Patent Number: 5,434,596

[45] Date of Patent: Jul. 18, 1995

[54] QUARTER-TONE THERMAL BACKPRINTING

[75] Inventor: Stanley W. Stephenson, Spencerport, N.Y.

[73] Assignee: Eastman Kodak Company, Rochester, N.Y.

[21] Appl. No.: 955,779

[22] Filed: Oct. 2, 1992

[51] Int. Cl.[6] ..... B41J 2/325

[52] U.S. Cl. ..... 347/171

[58] Field of Search ..... 346/76 PH; 400/120

[56] References Cited

U.S. PATENT DOCUMENTS

| | | | |
|---|---|---|---|
| 4,261,271 | 4/1981 | Brownstein | 346/76 PH |
| 4,555,714 | 11/1985 | Takanashi et al. | 346/76 PH |
| 4,559,542 | 12/1985 | Mita | 346/76 PH |
| 4,629,312 | 12/1986 | Pearce et al. | 346/76 PH |
| 4,652,892 | 3/1987 | Tanaka | 346/76 PH |
| 4,683,479 | 7/1987 | Horiya et al. | 346/76 PH |
| 4,691,211 | 9/1987 | Brownstein | 346/76 PH |
| 4,751,520 | 6/1988 | Mizoguchi | 346/76 PH |
| 4,823,163 | 4/1989 | Rollet et al. | 355/41 |
| 4,843,409 | 6/1989 | Matsuzaki | 346/76 PH |
| 4,884,080 | 11/1989 | Hirahara et al. | 346/76 PH |
| 4,890,121 | 12/1989 | Hirahara et al. | 346/76 PH |
| 4,952,085 | 8/1990 | Rein | 346/76 PH |
| 5,099,259 | 3/1992 | Hirahara et al. | 346/76 PH |

*Primary Examiner*—Huan H. Tran
*Attorney, Agent, or Firm*—Raymond L. Owens

[57] ABSTRACT

A thermal backprinting apparatus 10 has a print head 18 that prints characters on the reverse side of sheet 12. The sheet is driven past a print head 18 to skip every other line and print head 18 is energized to print every other pixel and form a quarter-tone image.

27 Claims, 3 Drawing Sheets

QUARTER-TONE THERMAL BACKPRINTING

BACKGROUND

The present invention relates to thermal printers, and, in particular, to thermal printers for printing quarter-tone images on the reverse side of image-bearing media.

In certain printing equipment, such as silver-halide printers, or electro-photographic printers, or thermal printers, large numbers of images can be produced over time. Especially in large volume printing applications, it becomes important to identify individual prints with such information as the owner of the print or the condition that existed to create the print or the source of the image. In these printers, such information is printed on the back, or non-image bearing, reverse surface of the prints. This is especially true in photographic style images, that cover the entire obverse surface of the print. In these photographic style prints, it is undesirable to have the labelling information on the front surface or attached as a tag.

In photographic systems, several techniques have been used to create labels on the back of the prints. In the Kodak 3510 printer, for instance, an impact printing system is used to record information on the back of prints. These impact printers typically have a ribbon that carries dye disposed in a vegetable oil. The impact of the hammers transfers some of the ink to the back of the print. One disadvantage of this method is that the ink can smear in the presence of water and solvents. Another disadvantage of this method is that high impact forces can cause marks on the silver halide emulsion.

Recently, improvements have been made in thermal printing systems that have made the use of thermal printers attractive in marking the backs of prints. See, for example, the thermal backprinting apparatus shown in U.S. Pat. No. 4,629,312. This technology uses a thermal print head, which consists of a number of thermally resistive elements, to transfer compounds from a carrier web. In one embodiment, the marking compound is a wax compound. These compounds tend to smear and have poor durability. More recently, compounds have been formulated of resins such as polyethylene or polyolefins. These polymers have exhibited improved wear, solvent and scratch resistance.

Using a thermal marking system to label the backs of prints from thermal, electrophotographic and silver-halide printers presents several problems. The thickness of the media receiving backprinting varies from 0.005 to 0.007 inches. The image material is a compound structure of paper with two sided coatings of a low density polymer, such as polypropylene or poly-ethylene. As such, the media are generally translucent. The thermal transfer material is a resin laden with carbon black. A typical thermal printer uses a print head with a linear array of 512 heating elements to create a 7×9 pixel array for each character. The transfer material is engaged by the head, pressed against the back of a print, and the array is energized. After backprinting, the dark, backprinted text forms a shadow on the obverse image. Such a shadow is especially noticeable when the print was placed against a white background or held up to bright lights. Such shadows are highly objectionable and render thermal backprinting unsuitable for commercial use.

SUMMARY

The invention provides a method and apparatus for thermal backprinting that reduces backprint shadows. The invention provides a thermal backprinter capable of quarter-tone printing. In particular, the thermal print head is energized and the print sheet is moved so that one printed pixel is not adjacent any other printed pixel. Stated another way, each printed pixel is circumscribed by background pixels. More specifically, for a linear array of thermal pixel printing elements, every other pixel printing element is energized and every other line is printed. In one embodiment, every other pixel printing element is disabled, otherwise incapable of being heated or simply omitted with its space left empty.

In an alternate embodiment comprising a matrix array of rows and columns of pixel printing elements, those elements are selectively energized so that any energized element is circumscribed by non-energized areas.

DETAILED DESCRIPTION

Figure 1:
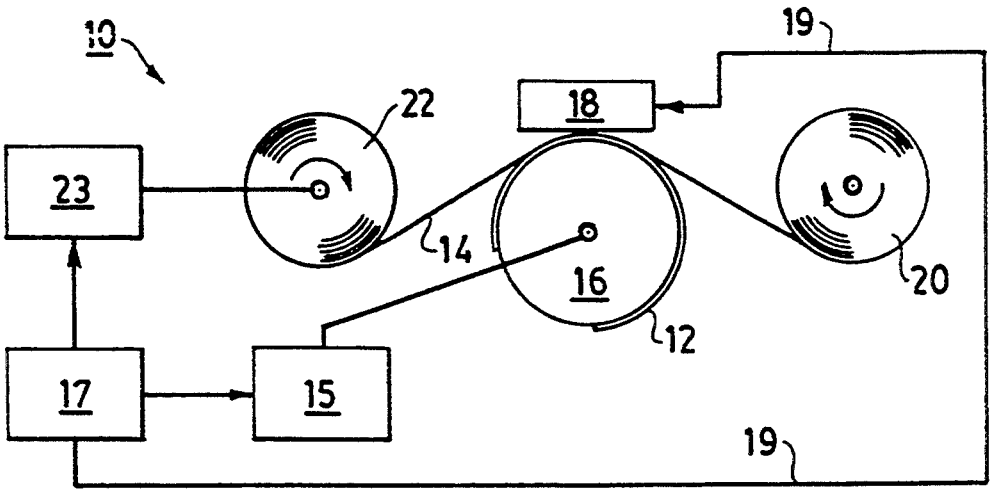
FIG. 1 is a partial, schematic end view of a preferred embodiment of the invention.

Referring to FIG. 1, there is shown in schematic form a backprinting apparatus 10 which is adapted to print alpha-numeric images on an image bearing sheet 12. The image bearing sheet 12 has a front, image bearing surface disposed facing the surface of a platen drum 16. The back surface of sheet 12 faces a backprint carrier web 14 disposed between the image bearing sheet 12 and a print head 18. The platen drum 16 is mechanically coupled to a drive mechanism 15 that is operated under control of a controller 17. Drive mechanism 15 advances the drum 16 and the image bearing sheet 12 past the stationary print head 18 during a printing cycle.

The print head 18 has a plurality of heating elements (See FIG. 2) which press the backprint web 14 against the back surface of the image bearing sheet 12. The backprint web 14 is driven from a supply roller 20 onto a takeup roller 22 by a drive mechanism 23 coupled to the takeup roller 22. The drive mechanisms 15 and 23 each include a stepper/gear motor which advances the backprint carrier web 14 and the image bearing sheet 12 relative to the heating elements of the print head 18. As will be clear to those skilled in the art, the motors of the mechanisms 15 and 23 can be DC motors. The print head 18 is electrically coupled via line 19 to the controller 17. Controller 17 controls the operations of the drive mechanisms 23, 15 as well as the electrical energization of the heating elements of the print head 18.

Figure 2:
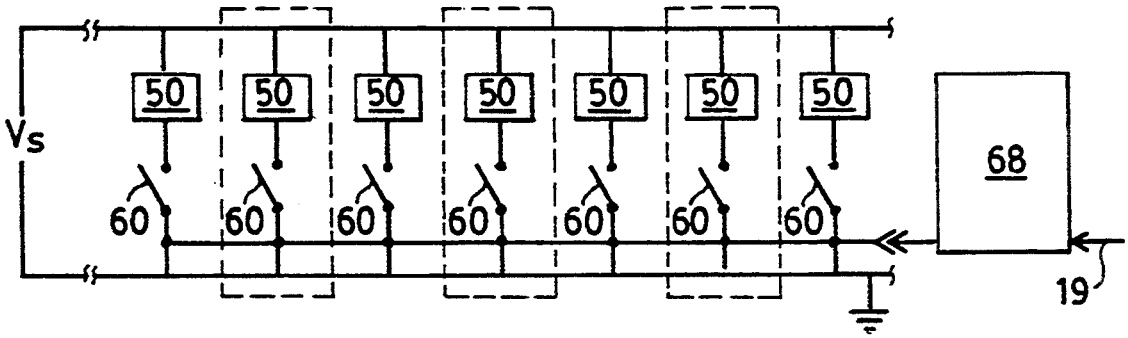
FIG. 2 is a partial, schematic of thermal pixel printer elements used in the embodiment of FIG. 1.

With reference to FIG. 2, selected thermal pixel resistive heating elements 50 are schematically illustrated. Elements 50 are selectively energized by closing respective switching elements 60. Upon closure of the switch element 60 with a thermal pixel element 50, a voltage from a voltage source $V_s$ is disposed across pixel 50. Current flows through the thermal pixel 50 causing it to rise in temperature. The accompanying rise in temperature causes the transfer of material carried on the backprint web 14 from web 14 to the back surface of image bearing sheet 12. Controller 17 is operative to individually address one or more of the switch elements 60. In the preferred embodiment of the invention every other switching element 60 is addressed by the controller 17. In addition, controller 17 operates the drive mechanisms 23 and 15 to cause the platen 16 to move and the print head 18 to be de-energized every other line so as to skip every other line in printing characters.

With reference to FIGS. 1 and 2, the operation of apparatus 10 will be briefly described. Drive signals are provided to the drive mechanisms 15, 23 from the controller 17. Controller 17 may be in the form of a microcontroller or microcomputer. Control signals from controller 17 cause the drum 16 to rotate and bring successive, contiguous areas of the image bearing sheet 12 beneath and opposite print head 18. A portion of the backprint web 14 is disposed between the print head 18 and the image bearing sheet 12. In a manner well known in the art, controller 17 provides signals via control line 19 to the print head 18 for selectively energizing the printing elements 50–56. For examples of control techniques and apparatus including microcontrollers for controlling print heads, see, U.S. Pat. Nos. 4,621,271; 4,691,211, all assigned to the same assignee as this patent.

Figure 3:
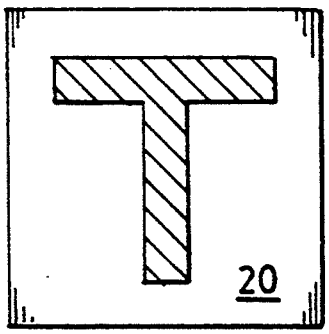
FIG. 3 PRIOR ART
FIG. 3 is an illustration of an example of prior art backprinting.
Figure 4:
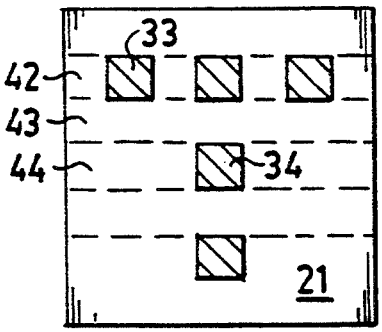
FIG. 4 is an example of backprinting using the invention.

By the selective energization of every other print element 50, and by the skipping of every other line of print, the present invention yields a quarter-tone image such as that shown in FIG. 4. The quarter-tone image of FIG. 4 is advantageous in that it contains enough information to render the letter "T" recognizable and at the same time contains few enough pixel elements so that shadows cast onto the front side of image bearing member 12 are substantially reduced. An example of a prior art technique, shown in FIG. 3, has resulted in undesireable shadows cast upon the obverse side of image bearing member 12, particularly when the sheet 12 is disposed against a white background or is illuminated by light from its reverse side. It will be noted that in FIG. 4, each printed pixel is circumscribed by eight background pixels. In no event is a printed pixel adjacent any other printed pixel.

With reference to FIG. 4, it can be seen that for example pixel 33 is surrounded by blank or background pixels. In addition, line 42 that contains pixel 33 is followed by a blank line 43. The next line bearing pixels is line 44, and so on. The result is that any printed pixel is always surrounded by blank pixels. Prints made using this method produced text that appears gray due to the fact that each individual pixel 33 is small thereby effectively producing a quarter-tone image. When the front images are viewed on top of a white background or with a strong light from the back, the text of the back has a significantly reduced shadow effect on the image bearing surface of sheet 12. Moreover, the resulting text printed on the back of sheet 12 is clearly legible and commercially acceptable.

In the preferred embodiment of the invention, an edge type thermal print head 18 manufactured by ROHM, part number KT2002-CA, was used. This particular head 18 consists of 512 thermal pixel elements 50 indicated as resistors. The thermal pixel elements are pitched at eight elements per millimeter. Each thermal pixel element 50 can be independently fired by shifting in 512 data bits from controller 17 into a shift register 61. On a rising signal of a clock 20, the data stored in shift register 61 is transferred to latch 59. The platen 16 generally consists of a 0.719 inch diameter roller that is driven by a stepper/gear motor drive 15 having a stepping rate of 480 steps per revolution. The print media disposed on carrier web 14 was a typical thermal resin transfer material. In the preferred embodiment the material was a resin type R5 manufactured by Astro-Med Corporation. The stepper motor drive mechanism 15 and the print head 18 are controlled by controller 17 that receives a data string which is decoded into a firing sequence for the head 18. Depending upon the particular media used on web 14, between 12 and 18 volts are required for $V_s$ in order to transfer the media in 2.5 m sec time period. The media in the resin transfer is an all-or-nothing process, whereby the resin delaminates from the carrier web 14 and warm flows under pressure from the head 18 so that it bonds to the back surface of image bearing sheet 12. As mentioned above, the text string was so printed that for every pixel that might be printed a blank pixel was printed and for every printed line, the stepper motor drive mechanism 15 was advanced an additional two pulses without energizing the print head 18 so as to create a line of blank pixels.

Figure 5:
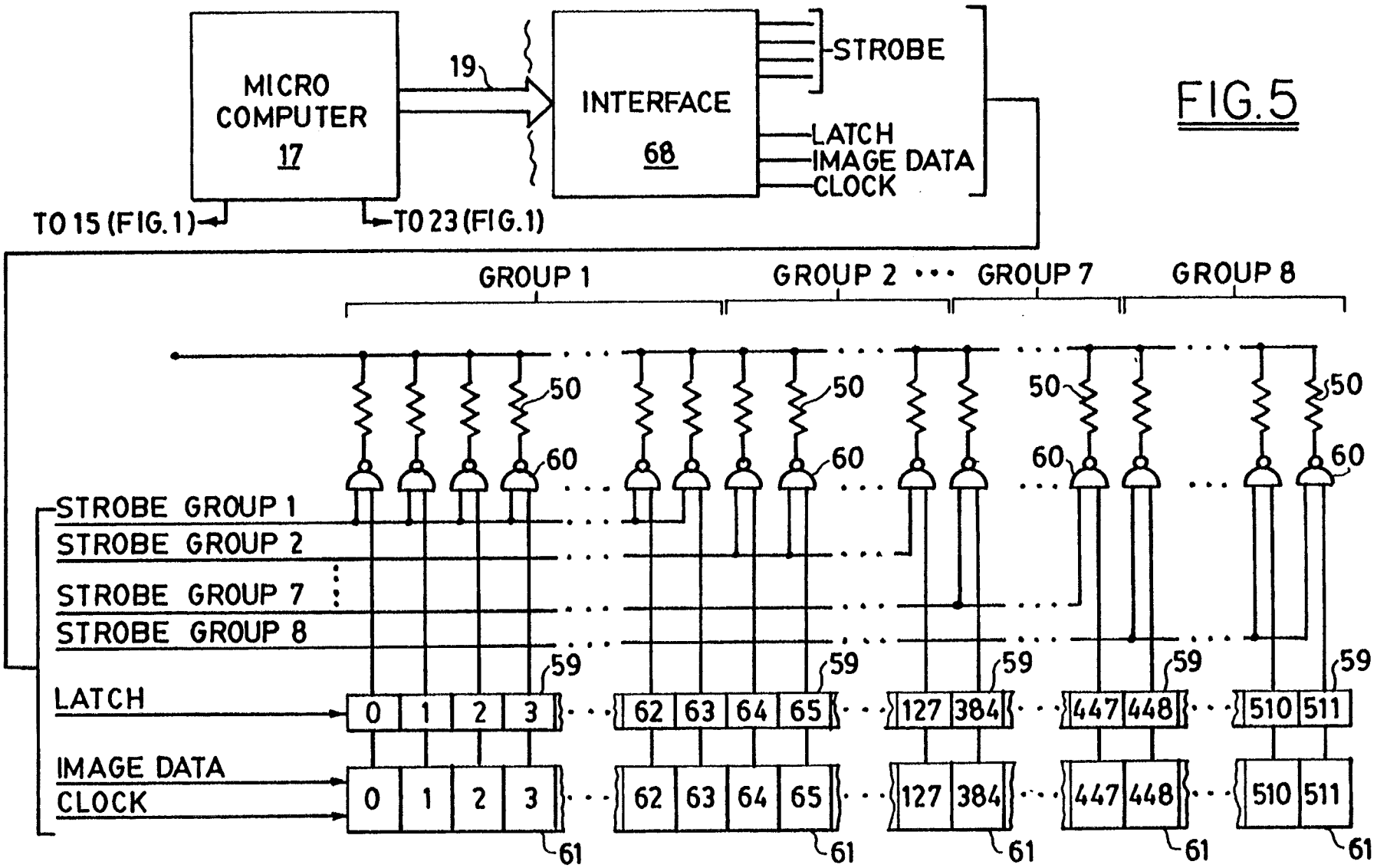
FIG. 5 is a schematic of the control circuit and system for operating the thermal pixels of the print head.

FIG. 5 illustrates in more detail a control circuit 42 for print head 18. The print head 18 is energized in response to signals that represent a line of data, e.g., row 42 of FIG. 4. These signals are stored as data in the memory of controller 17. As a numerical example, the print head assembly can be formed of 512 individual thermal pixels 50. One line at a time is printed. Each thermal pixel 50 is shown as a resistor. The first 64 thermal pixels (0–63) are assigned to Group 1. The next 64 thermal pixels (64–127) are assigned to Group 2. Groups 3–8 are each assigned 64 thermal pixels. Each thermal pixel is electrically connected to a constant voltage power supply (shown as $V_s$ in FIG. 2) and a NAND gate 60. When both inputs to a NAND gate 60 are high, the output of the NAND gate 60 is connected to ground and a current pulse is generated. One input to each NAND gate is from a group strobe signal and the other input is from a stage of a series of flip-flop latches 59 which contains 512 stages, one for each NAND gate. The latches are connected in parallel to the 512 stages of a shift register 61.

Current pulses are applied to a single thermal pixel 50. The pulse width is the time period a group strobe signal is on. After all the groups have been addressed one time the above process is repeated N-1 times. After data are latched in the latches 59, a new line of data are entered into the 512 shift register stages. This process of entering data in the shift register can take place while thermal pixels are being energized. The duty cycle of a thermal pixel is that time equal to the pulse width divided by the repetition period.

In an operation, interface 68 under the control of the controller 17 provides clock signals to the shift register 61. At the same time a binary test data signal is clocked into the stages of the shift register 61 until all 512 stages either contain a high "1" or a low "0" signal level or state. A latch signal causes the data in each of the shift register stages to be entered into the corresponding stages of the latches 59. A high signal level signal held on the output of its latch stage is connected to its corresponding NAND gate 60. The thermal pixels of each group may be simultaneously addressed (the group enable signal is high) in parallel, in sequence, or in a staggered manner e.g. all even numbered groups and then all odd numbered groups by providing a high group enable signal. The particular pattern chosen for addressing the groups will depend upon the amount of current required to effect a heat transfer of material from a web 14 and the heat disapating characteristic of the thermal pixel element 50.

In another embodiment of this invention, it is proposed that print head 18 may be modified to permanently include blank pixels for every other pixel printing element. So, for example, in FIG. 2, every other thermal pixel element 50 would simply be omitted from the print head 18. Such omission is indicated in the FIG. 2 by the dashed outline surrounding print elements. This new head would have no further need for control circuitry to blank the pixels since the heating elements associated with such pixels would be missing. Thus, a printing apparatus 10 would load only half as much data, and, depend upon the physical head structure to provide the horizontal element of the quarter-toning process. The blank line control accomplished by controller 17 and drive mechanism 15 would still be required. The advantages of such a custom head would be a lower cost and lower demand on the printer control electronics by reducing over all data load rates.

Figure 6A:
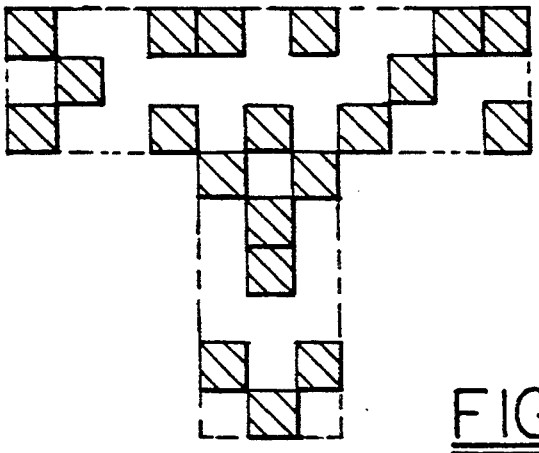
Figure 6B:
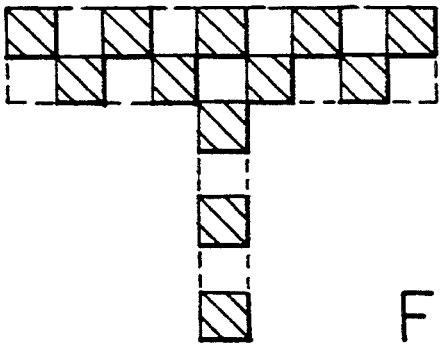

The preferred embodiment of the invention is the quarter tone printing application described above. However, in its broader aspects the invention contemplates other applications in which less than all of the contiguous pixels of a character are printed. Those skilled in the art understand that a given text or character can be scaled up in size to include a number of pixels. For example, the letter "T" of FIGS. 3 and 4 could be scaled to have a top leg of two or more rows of pixels. Likewise, the vertical leg could include two or more columns. With such a scaled font, one could print more than a quarter tone image but less than every pixel and still achieve a backprinted character with a reduced shadow. As such, the invention includes such scaled font applications where some but not all contiguous pixels are printed. See FIG. 6 for examples of such scaled applications with reduced shadows. Inasmuch as fonts can be selected from available computer software, e.g., Postscript, in order to practice the invention one skilled in the art could modify such programs to print only a predetermined fraction of possible pixels. In the preferred embodiment, one of nine pixels are printed. But the invention would work equally as well with slightly more or less a percentage of pixels, e.g., 10%–30%. Other percentages are selectable and will depend upon the scale of a font, the translucence of the image bearing sheet, the density of ink, and other factors well known in the art of printing thermal text on translucent material.

Having thus described the preferred embodiments of the invention, those skilled in the art will appreciate that further modifications and changes may be made to the invention without departing from the spirit and scope of the following claims.

I claim:

1. A method for reducing shadows from groups of pixels printed on one side of a two-sided sheet bearing an image on the other side; said method comprising:

providing a web of thermally transferable substance disposing the web between a thermal print head and the one side of said sheet;

selectively energizing said print head to print a plurality of pixels of said thermally transferable substance onto the one side of said sheet with no printed pixel being adjacent any other printed pixel; and selectively moving said sheet.

2. The invention of claim 1 wherein each of said printed pixels is circumscribed by a plurality of unprinted, blank background pixels.

3. The invention of claim 1 wherein the print head has a plurality of energizable transfer elements and every other one of said energizable elements of said print head is energized.

4. The invention of claim 3 wherein said print head has a non-energizable element disposed adjacent each of said energizable elements.

5. The invention of claim 4 wherein each of said printed pixels is contiguous to one or more unprinted, blank background pixels.

6. The invention of claim 4 wherein every other element of said print head is non-energizable.

7. The invention of claim 4 wherein the sheet is selectively moved to provide a line of unprinted, blank background pixels after a line containing printed pixels.

8. The invention of claim 4 wherein the print head comprises a plurality of elements disposed in a matrix of rows and columns and each one of said energizable elements is contiguous to one or more of said non-energizable elements.

9. The invention of claim 1 wherein the sheet is selectively moved to provide a line of unprinted, blank background pixels after each line containing printed pixels.

10. The invention of claim 1 wherein the print head comprises a plurality of selectively energizable elements disposed in a matrix of rows and columns and each element which is energized is circumscribed by elements which are not energized.

11. An apparatus for printing indicia formed of pixels printed onto one side of a two sided receiver bearing an image on the other side: said apparatus comprising:

a thermal print head having a plurality of selectively energizable thermal print elements;

a receiver having one side disposed toward said print head and another side bearing images;

a web of thermal transfer material disposed between the print head and the receiver;

means for selectively energizing print elements of the print head to form a plurality of printed pixels on the one side of the receiver such that no one of said printed pixels is adjacent another one of said printed pixels; and means for selectively driving said receiver, such that no one of said printed pixels is adjacent another one of said printed pixels.

12. The invention of claim 11 wherein each of said printed pixels is circumscribed by a plurality of background pixels.

13. The invention of claim 11 wherein the thermal print head comprises a linear array of thermal print elements.

14. The invention of claim 13 wherein every other one of said thermal print elements is energizable.

15. The invention of claim 1 wherein every other one of said thermal print elements is energized.

16. The invention of claim 11 wherein the means for selectively driving the receiver comprise a motor coupled to said receiver and operable to advance said receiver one line at a time.

17. The invention of claim 16 wherein the motor is driven to skip a line between printed pixels.

18. The invention of claim 11 wherein the thermal print head comprises a matrix of energizable thermal print elements arranged in a plurality of rows and columns wherein each thermal print element which is energized is circumscribed by thermal print elements which are not energized.

19. A method for reducing shadows on a front surface of a translucent sheet having front and back surfaces and indicia printed on the back surface, said method comprising:

providing a web of thermally transferable substance;

disposing the web between a thermal print head and the back surface of said sheet; and selectively energizing said print head to print only non-contiguous pixels of said thermally transferable substance onto the back surface of said sheet, whereby a strong shadow image of the pixels printed on the back surface is not produced on said front surface.

20. An apparatus for printing indicia formed of printed pixels on a back surface of a translucent sheet having front and back surfaces; said apparatus comprising:

a thermal print head having a plurality of selectively energizable thermal print elements;

a platen for carrying a sheet of translucent material having the front surface bearing images and the back surface disposed toward said print head;

a web of thermal transfer material disposed between the print head and the platen;

means for driving said platen to move the sheet relative to the print head; and means for selectively energizing the print head and transferring enough non-contiguous printed pixels to the back surface of said sheet to reduce a shadow image of said pixels on said front surface.

21. The invention of claim 20 wherein each of the printed pixel is contiguous to one or more unprinted, blank background pixels.

22. The invention of claim 20 wherein the thermal print head comprises a linear array of thermal elements.

23. The invention of claim 22 wherein every other one of said thermal elements is energizable.

24. The invention of claim 20 wherein every other one of said thermal print elements is energized.

25. The invention of claim 20 wherein the means for driving the platen comprise a motor coupled to said platen and operable to advance said platen one line at a time.

26. The invention of claim 25 wherein the motor is driven to skip a line between printed pixels.

27. The invention of claim 20 wherein the thermal print head comprises a matrix of energizable thermal elements arranged in a plurality of rows and columns wherein each one of said energizable thermal elements is contiguous to one or more non-energizable thermal elements.

* * * * *